US007221375B2

(12) United States Patent
Hall et al.

(10) Patent No.: US 7,221,375 B2
(45) Date of Patent: May 22, 2007

(54) SYSTEM AND METHOD FOR GENERATING DITHERING PATTERNS ASSOCIATED WITH A DIGITAL IMAGE

(75) Inventors: Deirdre M. Hall, Beverly, MA (US); Won-Suk Chun, Belmont, CA (US)

(73) Assignee: Actuality Systems, Inc., Bedford, MA (US)

( * ) Notice: Subject to any disclaimer, the term of this patent is extended or adjusted under 35 U.S.C. 154(b) by 160 days.

(21) Appl. No.: 10/977,063

(22) Filed: Oct. 29, 2004

(65) Prior Publication Data

US 2006/0092173 A1 May 4, 2006

(51) Int. Cl.
*G09G 5/02* (2006.01)

(52) U.S. Cl. ..... 345/596; 345/592

(58) Field of Classification Search ..... None
See application file for complete search history.

(56) References Cited

U.S. PATENT DOCUMENTS

| | | | | |
|---|---|---|---|---|
| 2,967,905 | A | 1/1961 | Hirsch | 178/6.5 |
| 3,140,415 | A | 7/1964 | Ketchpel | 313/146 |
| 4,829,365 | A | 5/1989 | Eichenlaub | 358/3 |
| 5,172,251 | A | 12/1992 | Benton et al. | 359/9 |
| 6,100,862 | A | 8/2000 | Sullivan | 345/88 |
| 6,554,430 | B2 | 4/2003 | Dorval et al. | 353/7 |
| 6,573,893 | B1 | 6/2003 | Naqvi et al. | 345/424 |
| 6,753,990 | B1 | 6/2004 | Payne et al. | 359/22 |
| 6,809,740 | B1 * | 10/2004 | Weed | 345/589 |

OTHER PUBLICATIONS

Gregg Favalora et al.; Volumetric Three-Dimentional Display System with Rasterization Hardware; Stereoscopic Displays And Virtual Reality Systems VIII; Proceedings of SPIE vol. 4297 (2001) pp. 227-235.

Greg Humphreys et al.; WireGL: A Scalable Graphics System for Clusters.

G. Favalora et al.; A Multi-Megavoxel Volumetric 3-D Display System for Distributed Collaboration; Workshop on Application of Virtual Reality Technologies for Future Telecommunication System (in conjunction with IEEE Globecom'2000); Nov. 27, 2000; San Francisco, USA; pp. 10-14.

(Continued)

*Primary Examiner*—Mark Zimmerman
*Assistant Examiner*—Kevin Xu
(74) *Attorney, Agent, or Firm*—Cantor Colburn LLP

(57) ABSTRACT

A system and a method for generating dithering patterns associated with a digital image are provided. The method includes generating a first table index value indicative of a location in a first table where first, second, and third color intensity values associated with a plurality of pixels on the display device are stored. The method further includes transmitting the first table index value from a computer to a second device via a communication bus. The method further includes accessing the first table using the first table index value to obtain the first, second, and third color intensity values associated with the plurality of pixels, the accessing being performed by the second device. The method further includes generating first, second, and third dithering patterns associated with the plurality of pixels based on the first, second, and third color intensity values, respectively, and position values indicative of positions of the plurality of pixels.

21 Claims, 5 Drawing Sheets

OTHER PUBLICATIONS

Pemberton, Duane; Wicked 3D Voodoo2 & 3D Shutter Glasses Game Review; www.gamers-depot.com/rev-wicked3d.htm.
Greg Humphreys et al.; Chromium: A Stream-Processing Framework for Interactive Rendering on Clusters.
Gordon Stoll et al.; Lightning-2: A High-Performance Display Subsystem for PC Clusters.
NVIDIA Corp.; 3D Stereo Techinical Brief; TB-00271-001; Nov. 21, 2001; pp. 1-11.

* cited by examiner

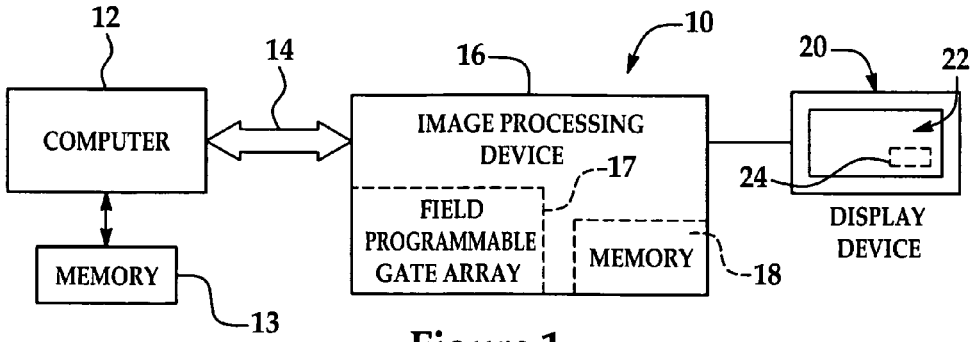
Figure 1
40
42
44
| TABLE INDEX VALUE | RED COLOR INTENSITY VALUE | GREEN COLOR INTENSITY VALUE | BLUE COLOR INTENSITY VALUE |
|---|---|---|---|
| 00000000 | 00000 | 00001 | 00010 |
| 00000001 | 00001 | 00001 | 00010 |
Figure 2
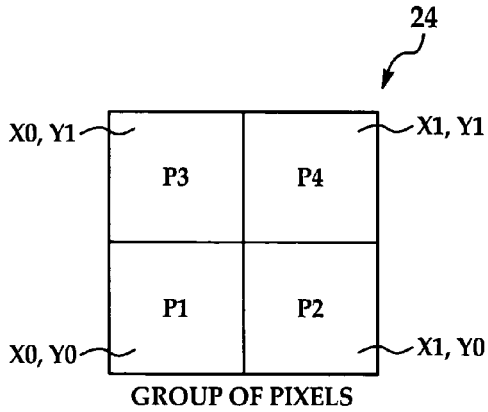
Figure 3
48
| X0, Y0 | DV1 |
|---|---|
| X1, Y0 | DV2 |
| X0, Y1 | DV3 |
| X1, Y1 | DV4 |
TABLE OF DITHERING VALUES
Figure 4

SYSTEM AND METHOD FOR GENERATING DITHERING PATTERNS ASSOCIATED WITH A DIGITAL IMAGE

BACKGROUND OF THE INVENTION

Digital images generated by a computer are generally displayed on a display device. Each digital image is generally displayed by controlling an output of a relatively large number of pixels on the display device. Generally, the computer transmits red, green, and blue color intensity values associated with a pixel to an image processing device. Thereafter, the image processing device selects one pixel control value for the pixel from a table wherein the pixel control value is used to control operation of the pixel.

There are significant drawbacks, however, with the foregoing methodology. In particular, the computer transmits an index value for each pixel to the image processing device. Thus, when generating a digital image represented by thousands of pixels, the computer is required to transmit thousands of index values through a communication bus to the image processing device. As a result, the desired bandwidth for transmitting the index values may exceed the bandwidth of the communication bus between the computer and the image processing device. When this occurs, a presentation of a plurality of digital images by the display device may become undesirably "choppy" or discontinuous.

Accordingly, there is a need for a system and a method for generating dithering patterns for a plurality of pixels that utilizes a single index value for controlling operation of the plurality of pixels.

BRIEF DESCRIPTION OF THE INVENTION

A method for generating dithering patterns associated with a digital image for a display device in accordance with an exemplary embodiment is provided. The method includes generating a first table index value indicative of a location in a first table where first, second, and third color intensity values associated with a plurality of pixels on the display device are stored. The method further includes transmitting the first table index value from a computer to a second device via a communication bus. The method further includes accessing the first table using the first table index value to obtain the first, second, and third color intensity values associated with the plurality of pixels, the accessing being performed by the second device. The method further includes generating first, second, and third dithering patterns associated with the plurality of pixels based on the first, second, and third color intensity values, respectively, and position values indicative of positions of the plurality of pixels.

A system for generating dithering patterns associated with a digital image for a display device in accordance with another exemplary embodiment is provided. The system includes a computer configured to generate a first table index value indicative of a location in a first table where first, second, and third color intensity values associated with a plurality of pixels on the display device are stored. The computer is further configured to transmit the first table index value through a communication bus. The system further includes a second device operably coupled to the communication bus configured to receive the first table index value. The second device is configured to access the first table using the first table index value to obtain the first, second, and third color intensity values associated with the plurality of pixels. The second device is further configured to generate first, second, and third dithering patterns associated with the plurality of pixels based on the first, second, and third color intensity values, respectively, and position values indicative of positions of the plurality of pixels.

BRIEF DESCRIPTION OF THE DRAWINGS

FIG. 1 is a block diagram of an image display system for generating dithering patterns associated with a digital image in accordance with an exemplary embodiment;

FIG. 2 is a schematic of a color palette table utilized by the image display system of FIG. 1;

FIG. 3 is a schematic of a group of pixels of a display device utilized in the image display system of FIG. 1;

FIG. 4 is a schematic of a table of dithering values utilized by the image display system of FIG. 1.

DETAILED DESCRIPTION OF THE INVENTION

Figure 5:
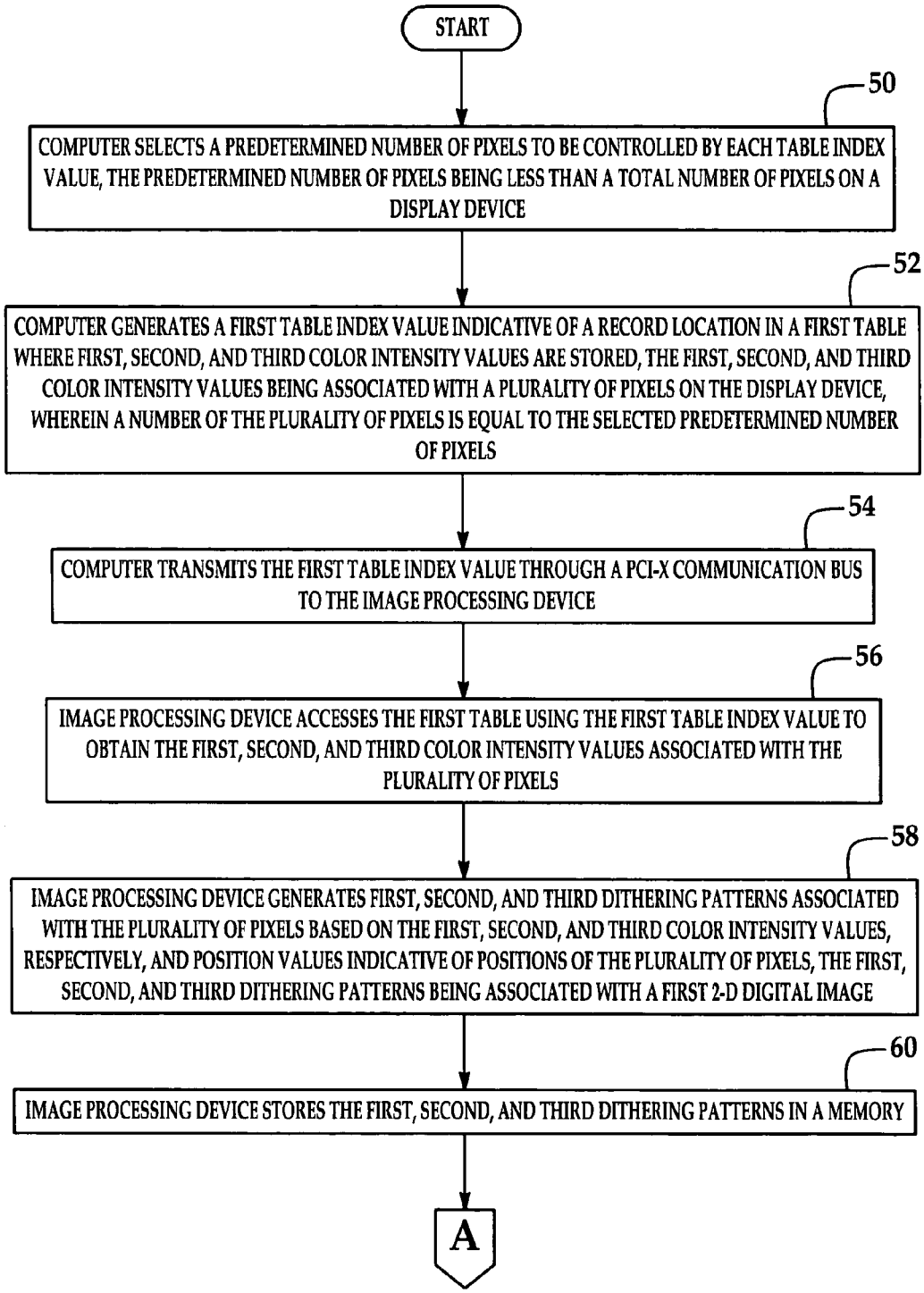
FIGS. 5–8 are flowcharts of a method for generating dithering patterns associated with a digital image in accordance with another exemplary embodiment.

Referring to FIG. 1, an image display system 10 for generating dithering patterns associated with digital images is illustrated. In particular, the image display system 10 utilizes a table index value for generating a dithering pattern for a plurality of pixels on a display device to render at least a portion of a digital image. By utilizing a table index value to control a dithering pattern of a plurality of pixels, an amount of data associated with a 2-D or a 3-D digital image that is transferred between the computer and an image processing device is greatly reduced. The image display system 10 includes a computer 12, a communication bus 14, an image processing device 16, and a display device 20.

The computer 12 is operably coupled to a memory 13 and a communication bus 14. The computer 12 is configured to retrieve a digital image from the memory 13 and to generate a plurality of table index values associated with the digital image. Each table index value comprises to an 8-bit number corresponding to a record location in the color palette table 40 stored in a memory 18 of the image processing device 16. After generating each table index value, the computer 12 transmits the table index value through the communication bus 14 to the image processing device 16. Each table index value is utilized by the image processing device 16 to generate dithering patterns for rendering a portion of the digital image on the display device 20, as will be explained in greater detail below.

The communication bus 14 is provided to transfer data between the computer 12 and the image processing device 16. The communication bus 14 comprises a PCI-X communication bus. Of course, in alternate embodiments, the communication bus 14 can comprise any bus capable of transmitting data between the computer 12 and the image processing device 16.

Referring to FIGS. 1 and 2, the image processing device 16 is provided to generate dithering patterns for a predetermined plurality of pixels based on each table index value received from the computer 12. The image processing device 16 comprises a field programmable gate array 17 and a memory 18. The field programmable gate array 17 is configured to generate dithering patterns as described in greater detail below. The memory 18 includes a color palette table 40 having a plurality of records wherein each record is accessed and identified by a distinct table index value. For purposes of simplicity, the color palette table 40 will only be described with respect to two records (e.g., records 42 and 44). However, the color palette table 40 can comprise a plurality of additional records. Each record in the table 40 includes an 8-bit table index value, a 5-bit red color intensity value, a 5-bit green color intensity value, and a 5-bit blue color intensity value. For example, the table 40 includes a record 42 having a table index value "00000000", a red color intensity value "00000", a green color intensity value "00001", and a blue color intensity value "00010". Further, the table 40 includes a record 44 having table index value "00000001", a red color intensity value "00001", a green color intensity value "00001", and a blue color intensity value "00010". In alternate embodiments, the field programmable gate array 17 can be replaced with a gate array, an ASIC device or a microprocessor.

Referring to FIG. 1, the display device 20 is provided to generate at least a portion of a digital image based on the dithering patterns received from the image processing device 16. The display device 20 comprises a digital mirror device. One type of digital mirror device includes three mirrors per pixel for focusing red, green, and blue light, respectively, on a pixel area. The display device 20 includes a pixel region 22 including thousands of pixels for displaying a digital image. Further, a subset of the pixel region 22 is defined by the plurality of pixels 24 that will be utilized to describe the operation of the image processing device 16. In alternate embodiments, the display device 20 comprises at least one of a cathode ray tube (CRT), a liquid crystal display (LCD) display device, a light emitting diode (LED) display device, or an organic LED display device. In still another embodiment, the display device 20 comprises a volumetric three-dimensional display device. For example, the display device 20 can comprise the display device described in U.S. Pat. No. 6,554,430 entitled Volumetric Three-Dimensional Display System, which is incorporated herein in its entirety. Of course, other types of volumetric three-dimensional display devices known to those skilled in the art could also be utilized for display device 20.

Figure 6:
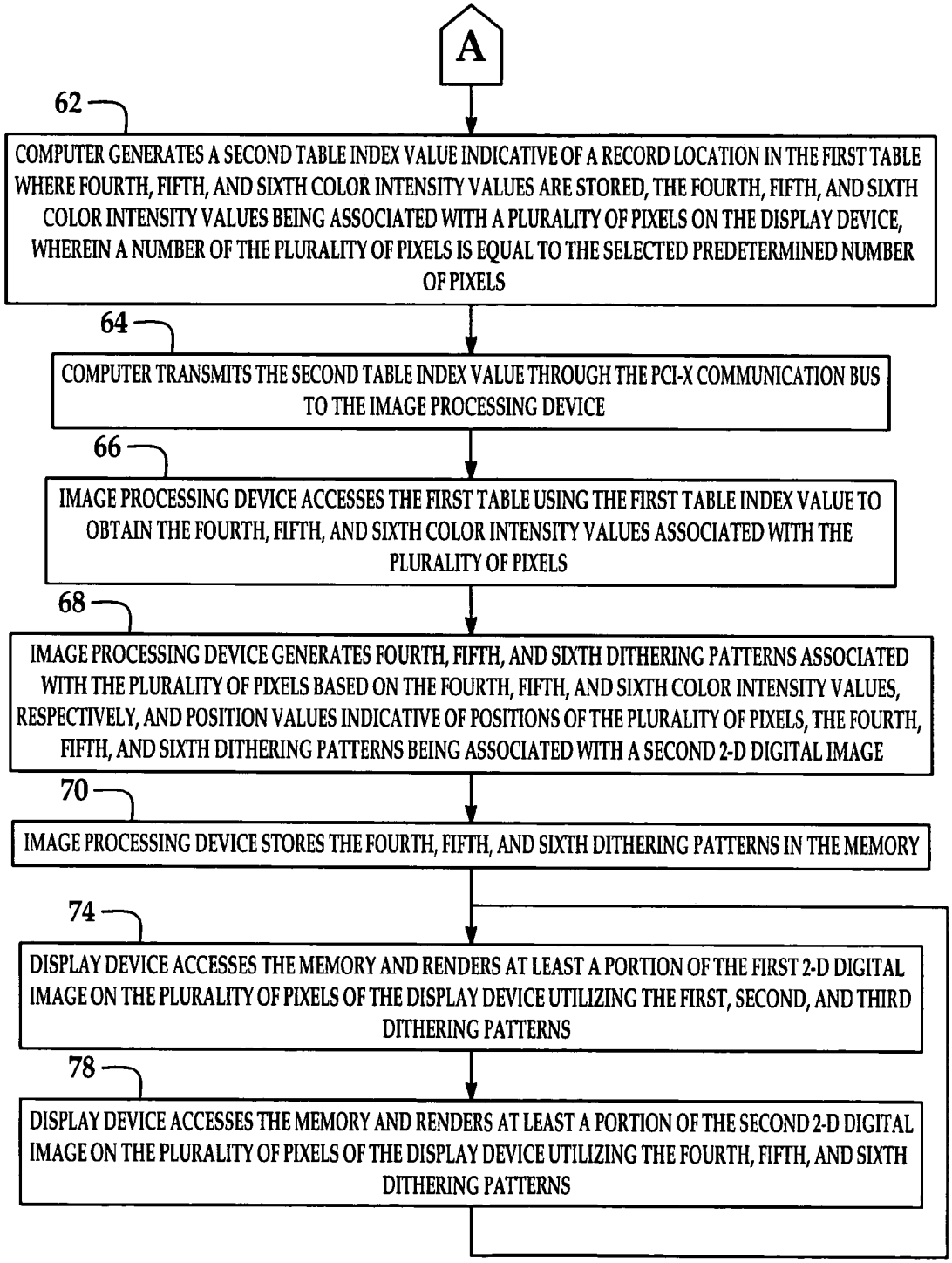
Figure 7:
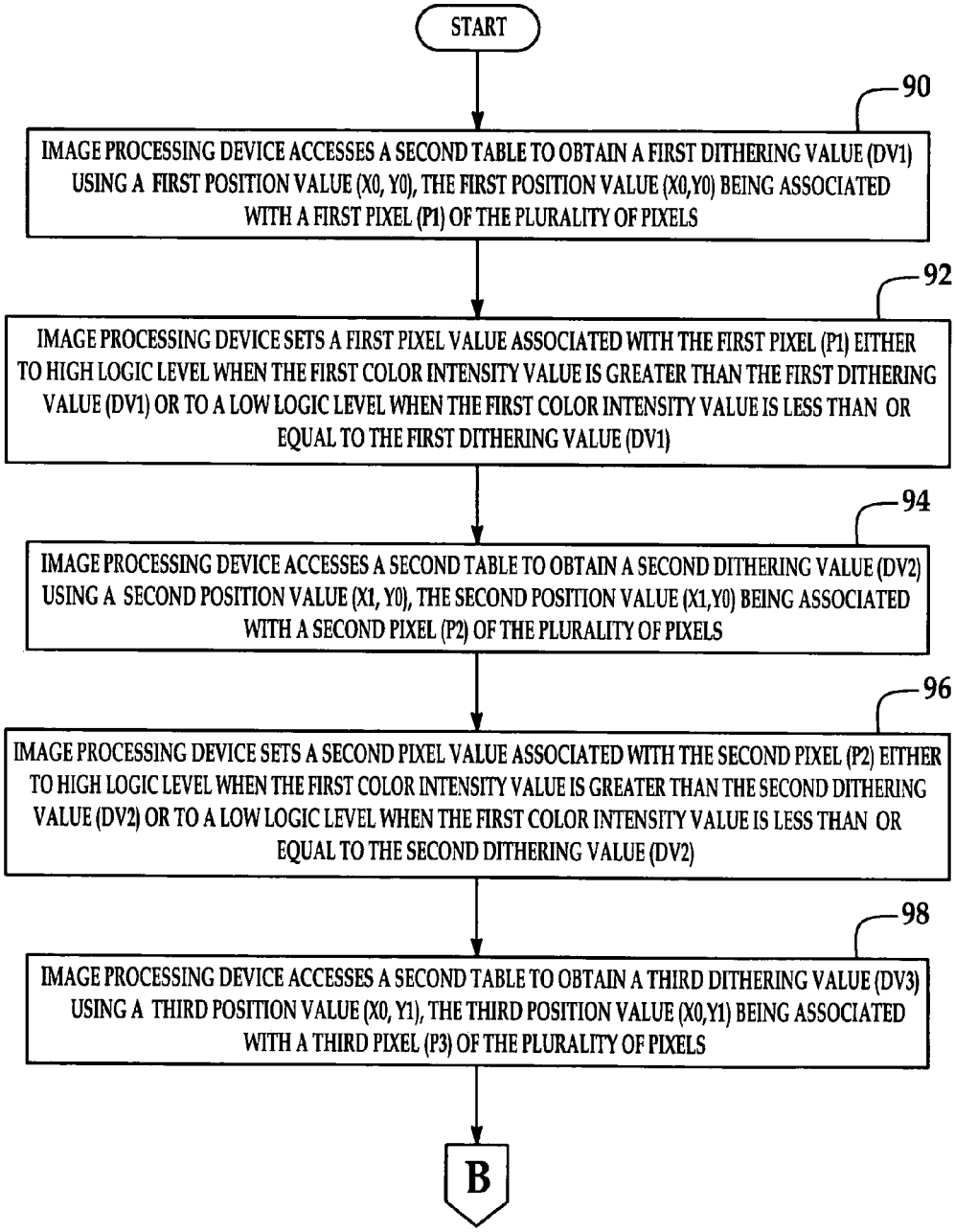
Figure 8:
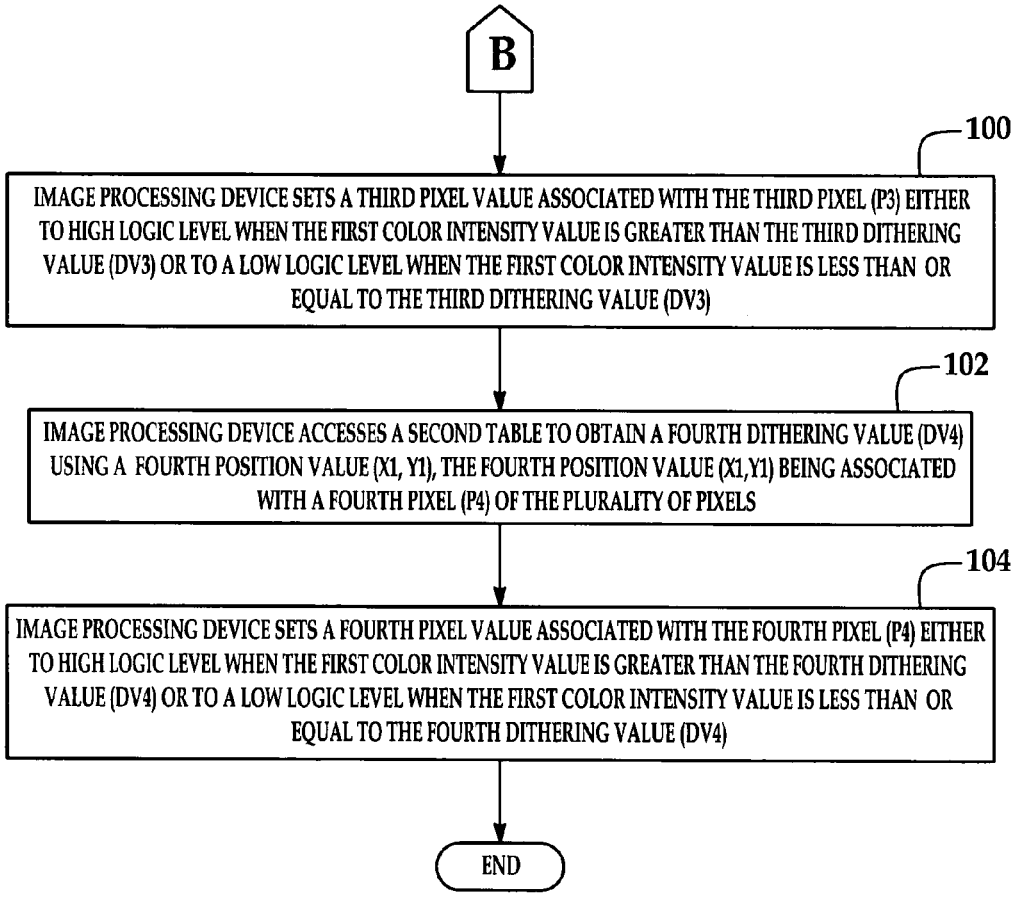

Referring to FIGS. 5–8, a method for generating dithering patterns associated with a digital image will now be explained. The following method can be implemented using the image display system 10.

At step 50, the computer 12 selects a predetermined number of pixels in the pixel region 20 to be controlled by each table index value. The predetermined number of pixels is a stored value in memory. In an alternate embodiment, the predetermined number of pixels is a user-defined value. The predetermined number of pixels is less than a total number of pixels in the pixel region 20. For example, if the computer 12 selects the number "4" for the predetermined number of pixels, each table index value generated by the computer 12 will be utilized to control four pixels in the pixel region 20. Of course, the computer 12 could select a predetermined number of pixels greater than or less than the number "4".

At step 52, the computer 12 generates a first table index value "00000000" indicative of a record 42 in the table 40 where a red color intensity value "00000", the green color intensity value "00001" and a blue color intensity value "00010" are stored. The red color intensity value "00000", the green color intensity value "00001", and the blue color intensity value "00010" are associated with a plurality of pixels 24 on the display device 20. The number of the plurality of pixels 24 (e.g., pixels P1, P2, P3, P4) is equal to the selected predetermined number of pixels (e.g., 4).

At step 54, the computer 12 transmits the table index value "00000000" through the communication bus 14 to the image processing device 16.

At step 56, the image processing device 16 accesses the record 42 in table 40 using on the table index value "00000000" to obtain the red color intensity value "00000", the green color intensity value "00001", and the blue color intensity value "00010" associated with the plurality of pixels 24.

At step 58, the image processing device 16 generates first, second, and third dithering patterns associated with the plurality of pixels 24 based on the red color intensity value "00000", the green color intensity value "00001", and the blue color intensity value "00010", respectively, and position values indicative of positions of the plurality of pixels 24, the first, second, and third dithering patterns being associated with a first 2-D digital image.

For purposes of understanding, a brief explanation for generating one of the dithering patterns of step 58 for four pixels based on the red color intensity value will now be explained utilizing steps 90–104.

At step 90, the image processing device 16 accesses table 48 stored in the memory 18 to obtain a first dithering value (DV1) using a first position value (X0, Y0), the first position value (X0, Y0) being associated with a first pixel (P1) of the plurality of pixels 24.

At step 92, the image processing device 16 sets a first pixel value associated with the first pixel (P1) either to a high logic level when the red color intensity value "00000" is greater than the first dithering value (DV1) or to a low logic level when the red color intensity value "00000" is less than or equal to the first dithering value (DV1).

At step 94, the image processing device 16 accesses the table 48 to obtain a second dithering value (DV2) using a second position value (X1, Y0), the second position value (X1, Y0) being associated with a second pixel (P2) of the plurality of pixels 24.

At step 96, the image processing device 16 sets a second pixel value associated with the second pixel (P2) either to a high logic level when the red color intensity value "00000" is greater than the second dithering value (DV2) or to a low logic level when the red color intensity value "00000" is less than or equal to the second dithering value (DV2).

At step 98, the image processing device 16 accesses the table 48 to obtain a third dithering value (DV3) using a third position value (X0, Y1), the third position value (X0, Y1) being associated with a third pixel (P3) of the plurality of pixels 24.

At step 100, the image processing device 16 sets a third pixel value associated with the third pixel (P3) either to a high logic level when the red color intensity value "00000" is greater than the third dithering value (DV3) or to a low logic level when the red color intensity value "00000" is less than or equal to the third dithering value (DV3).

At step 102, the image processing device 16 accesses the table 48 to obtain a fourth dithering value (DV4) using a fourth position value (X1, Y1), the fourth position value (X1, Y1) being associated with a fourth pixel (P4) of the plurality of pixels 24.

At step 104, the image processing device 16 sets a fourth pixel value associated with the fourth pixel (P4) either to a high logic level when the red color intensity value "00000" is greater than the fourth dithering value (DV4) or to a low logic level when the red color intensity value "00000" is less than or equal to the fourth dithering value (DV4).

Referring again to step 58, after the image processing device 16 generates the first, second, and third dithering patterns, the method advances to step 60.

At step 60, the image processing device 16 stores the first, second, and third dithering patterns in the memory 18.

At step 62, the computer 12 generates a table index value "00000001" indicative of a record 44 in the table 40 where the red color intensity value "00001", the green color intensity value "00001" and a blue color intensity value "00010" are stored. The red color intensity value "00001", the green color intensity value "00001", and the blue color intensity value "00010" are associated with the plurality of pixels 24 on the display device 20, wherein the number of the plurality of pixels is equal to the selected predetermined number of pixels.

At step 64, the computer 12 transmits the table index value "00000001" through the communication bus 14 to the image processing device 16.

At step 66, the image processing device 16 accesses the record 42 in the table 40 using the table index value "00000001" to obtain the red color intensity value "00001", the green color intensity value "00001", and the blue color intensity value "00010" associated with the plurality of pixels 24.

At step 68, the image processing device 16 generates fourth, fifth, and sixth dithering patterns associated with the plurality of pixels 24 based on the red color intensity value "00001", the green color intensity value "00001", and the blue color intensity value "00010", and position values indicative of positions of the plurality of pixels 24, the fourth, fifth, and sixth dithering patterns being associated with a second 2-D digital image (not shown).

At step 70, the image processing device 16 stores the fourth, fifth, and sixth dithering patterns in the memory 18.

At step 74, the display device 20 accesses the memory 18 and renders at least a portion of the first 2-D digital image on the plurality of pixels 24 of the display device 20 utilizing the first, second, and third dithering patterns.

At step 78, the display device 20 accesses the memory 18 and renders at least a portion of the second 2-D digital image on the plurality of pixels 24 of the display device 20 utilizing the fourth, fifth, and sixth dithering patterns. In particular, the display device 20 combines the first and second 2-D digital images to generate a 3-D digital image. After step 80, the method advances to step 74.

The system and method for generating dithering patterns associated with a digital image provide a substantial advantage over other systems and methods. In particular, the system and the method provide a technical effect of utilizing a single table index value for generating a dithering pattern for a plurality of pixels on a display device. Thus, an amount of data associated with a 2-D or a 3-D digital image that is transferred through a communication bus between the computer and image processing device is greatly reduced. As a result, the desired bandwidth for transmitting the index values generally will not exceed an operational bandwidth of the communication bus allowing digital images to be rendered on the display device at a desired speed and viewing quality.

While embodiments of the invention are described with reference to the exemplary embodiments, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited to the embodiment disclosed for carrying out this invention, but that the invention includes all embodiments falling with the scope of the intended claims. Moreover, the use of the term's first, second, etc. does not denote any order of importance, but rather the term's first, second, etc. are used to distinguish one element from another. Furthermore, the use of the terms a, an, etc. do not denote a limitation of quantity, but rather denote the presence of at least one of the referenced items.

What is claimed is:

1. A method for generating dithering patterns associated with a digital image for a display device, comprising:

generating a first table index value indicative of a location in a first table where first, second, and third color intensity values associated with a plurality of pixels on the display device are stored;

transmitting the first table index value from a computer to a second device via a communication bus;

accessing the first table using the first table index value to obtain the first, second, and third color intensity values associated with the plurality of pixels, the accessing being performed by the second device; and generating first, second, and third dithering patterns associated with the plurality of pixels based on the first, second, and third color intensity values, respectively, and position values indicative of positions of the plurality of pixels;

wherein generating the first dithering pattern comprises:

accessing a second table to obtain a first dithering value using a first position value, the first position value being associated with a first pixel of the plurality of pixels; and setting a first pixel value associated with the first pixel either to a high logic level when the first color intensity value is greater than the first dithering value or to a low logic level when the first color intensity value is less than or equal to the first dithering value.

2. The method of claim 1, further comprising storing the first, second, and third dithering patterns in a memory.

3. The method of claim 2, further comprising rendering a portion of a 2-D digital image on the plurality of pixels of a display device utilizing the first, second, and third dithering patterns.

4. The method of claim 1, further comprising selecting a predetermined number of pixels corresponding to the plurality of pixels, the predetermined number of pixels being less than a total number of pixels on a display device.

5. The method of claim 1, wherein the first color intensity value comprises a red color intensity value, the second color intensity value comprises a green color intensity value, and the third color intensity value comprises a blue color intensity value.

6. The method of claim 1, wherein each position value comprises both an x-coordinate and a y-coordinate on a display device.

7. The method of claim 1, wherein determining the first dithering pattern further comprises:

accessing the second table to obtain a second dithering value using a second position value, the second position value being associated with a second pixel of the plurality of pixels; and setting a second pixel value associated with the second pixel either to the high logic level when the first color intensity value is greater than the second dithering value or to the low logic level when the first color intensity value is less than or equal to the second dithering value.

8. The method of claim 1, further comprising:

generating a second table index value indicative of a location in the first table where fourth, fifth, and sixth color intensity values associated with the plurality of pixels on the display device are stored;

transmitting the second table index value from the computer to the second device via the communication bus;

accessing the first table using the second table index value to obtain the fourth, fifth, and sixth color intensity values associated with the plurality of pixels, the accessing being performed by the second device; and generating fourth, fifth, and sixth dithering patterns associated with the plurality of pixels based on the fourth, fifth, and sixth color intensity values, respectively, and position values indicative of positions of the plurality of pixels.

9. The method of claim 8, further comprising:

rendering a portion of a 3-D digital image on the plurality of pixels of a display device utilizing the first, second, third, fourth, fifth, and sixth dithering patterns.

10. A system for generating dithering patterns associated with a digital image for a display device, comprising:

a computer configured to generate a first table index value indicative of a location in a first table where first, second, and third color intensity values associated with a plurality of pixels on the display device are stored, the computer further configured to transmit the first table index value through a communication bus; and a second device operably coupled to the communication bus configured to receive the first table index value, the second device configured to access the first table using the first table index value to obtain the first, second, and third color intensity values associated with the plurality of pixels, the second device further configured to generate first, second, and third dithering patterns associated with the plurality of pixels based on the first, second, and third color intensity values, respectively, and position values indicative of positions of the plurality of pixels, wherein the second device is further configured to access a second table to obtain a first dithering value using a first position value, the first position value being associated with a first pixel of the plurality of pixels, the second device being further configured to set a first pixel value associated with the first pixel either to a high logic level when the first color intensity value is greater than the first dithering value or to a low logic level when the first color intensity value is less than or equal to the first dithering value.

11. The system of claim 10, wherein the second device is further configured to store the first, second, and third dithering patterns in a memory.

12. The system of claim 11, further comprising a display device configured to access the memory and to render a portion of a 2-D digital image on the plurality of pixels utilizing the first, second, and third dithering patterns.

13. The system of claim 10, wherein the computer is further configured to select a predetermined number of pixels corresponding to the plurality of pixels.

14. The system of claim 10, wherein the first color intensity value comprises a red color intensity value, the second color intensity value comprises a green color intensity value, and the third color intensity value comprises a blue color intensity value.

15. The system of claim 10, wherein each position value comprises both an x-coordinate and a y-coordinate on a display device.

16. The system of claim 10, wherein the second device is further configured to access the second table to obtain a second dithering value using a second position value, the second position value being associated with a second pixel of the plurality of pixels, the second device being further configured to set a second pixel value associated with the second pixel either to a high logic level when the first color intensity value is greater than the second dithering value or to a low logic level when the first color intensity value is less than or equal to the second dithering value.

17. The system of claim 10, wherein the computer is further configured to generate a second table index value indicative of a location in the first table where fourth, fifth, and sixth color intensity values associated with the plurality of pixels on the display device are stored, the computer further configured to transmit the second table index value from the computer to the second device via the communication bus, the second device further configured to access the first table using the second table index value to obtain the fourth, fifth, and sixth color intensity values associated with the plurality of pixels, the second device further configured to generate fourth, fifth, and sixth dithering patterns associated with the plurality of pixels based on the fourth, fifth, and sixth color intensity values, respectively, and position values indicative of positions of the plurality of pixels.

18. The system of claim 17, further comprising a display device configured to render a portion of a 3-D digital image on the plurality of pixels utilizing the first, second, third, fourth, fifth, and sixth dithering patterns.

19. The system of claim 10, wherein the second device comprises a field programmable gate array.

20. The system of claim 10, wherein the second device comprises an ASIC device.

21. The system of claim 10, wherein the display device comprises one of a digital mirror device, a CRT display device, an LCD display device, an LED display device, an organic LED display device, and a volumetric three-dimensional display device.

* * * * *